US008888390B2

(12) United States Patent
Gueret

(10) Patent No.: US 8,888,390 B2
(45) Date of Patent: Nov. 18, 2014

(54) VIBRATOR APPLICATOR HAVING SELECTIVE VIBRATION ORIENTATION

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 977 days.

(21) Appl. No.: 12/934,821

(22) PCT Filed: Mar. 9, 2009

(86) PCT No.: PCT/IB2009/050980

§ 371 (c)(1), (2), (4) Date: Nov. 23, 2010

(87) PCT Pub. No.: WO2009/125307

PCT Pub. Date: Oct. 15, 2009

(65) Prior Publication Data

US 2011/0110701 A1 May 12, 2011

Related U.S. Application Data

(60) Provisional application No. 61/048,438, filed on Apr. 28, 2008.

(30) Foreign Application Priority Data

Apr. 8, 2008 (FR) ..... 08 52360

(51) Int. Cl.

| | |
|---|---|
| ***A46B 11/00*** | (2006.01) |
| ***A46B 9/02*** | (2006.01) |
| ***A45D 40/26*** | (2006.01) |
| ***A46B 15/00*** | (2006.01) |
| ***A46B 13/02*** | (2006.01) |
| *A45D 34/04* | (2006.01) |
| *A45D 19/02* | (2006.01) |

(52) U.S. Cl.

CPC ..... *A45D 40/265* (2013.01); *A46B 2200/106* (2013.01); *A46B 2200/1053* (2013.01); *A46B 9/021* (2013.01); *A46B 15/0002* (2013.01); *A45D 34/045* (2013.01); *A45D 2200/207* (2013.01); *A46B 13/023* (2013.01); *A45D 19/02* (2013.01)

USPC ..... 401/4; 401/126; 401/129

(58) Field of Classification Search

USPC ..... 401/4, 126, 129; 132/218; 601/72, 73

See application file for complete search history.

(56) References Cited

U.S. PATENT DOCUMENTS

| | | | | |
|---|---|---|---|---|
| 3,653,530 | A * | 4/1972 | Winfrey | 215/302 |
| 7,172,357 | B2 * | 2/2007 | Gueret | 401/129 |

(Continued)

FOREIGN PATENT DOCUMENTS

| | | |
|---|---|---|
| EP | 1 369 056 A1 | 12/2003 |
| EP | 1 920 676 A1 | 5/2008 |

(Continued)

OTHER PUBLICATIONS

International Search Report dated Aug. 4, 2009 in corresponding International Application No. PCT/IB2009/050980.

(Continued)

*Primary Examiner* — David Walczak
*Assistant Examiner* — Bradley Oliver
(74) *Attorney, Agent, or Firm* — Oliff PLC

(57) ABSTRACT

An applicator for applying a cosmetic composition includes: an applicator member and a vibration source. The applicator is configured to enable the user to orient the vibration of the vibration source relative to the applicator member selectively in at least two different orientations, at one or more predefined locations.

12 Claims, 5 Drawing Sheets

(56) References Cited

U.S. PATENT DOCUMENTS

| | | | | |
|---|---|---|---|---|
| 7,481,592 | B2 | 1/2009 | Gueret | |
| 2004/0182410 | A1* | 9/2004 | Gueret | 132/218 |
| 2004/0185067 | A1 | 9/2004 | Daikuzono | |
| 2005/0107724 | A1* | 5/2005 | Dunmore | 601/15 |
| 2007/0025803 | A1* | 2/2007 | Dieudonat | 401/127 |
| 2007/0276301 | A1* | 11/2007 | Schefthaler | 601/86 |
| 2008/0087296 | A1 | 4/2008 | Gueret | |
| 2009/0071501 | A1 | 3/2009 | Gueret | |
| 2009/0154985 | A1* | 6/2009 | Wyatt et al. | 401/126 |

FOREIGN PATENT DOCUMENTS

| | | | |
|---|---|---|---|
| FR | 2 882 506 | A1 | 9/2006 |
| FR | 2 904 923 | A1 | 2/2008 |
| WO | WO 2006/020577 | A2 | 2/2006 |
| WO | WO 2006/090343 | A1 | 8/2006 |
| WO | WO 2006/130642 | A1 | 12/2006 |

OTHER PUBLICATIONS

Written Opinion of the International Searching Authority dated Aug. 4, 2009 in corresponding International Application No. PCT/IB2009/050980.

French Search Report dated Nov. 27, 2008 in corresponding French Patent Application No. 0852360 (with translation).

* cited by examiner

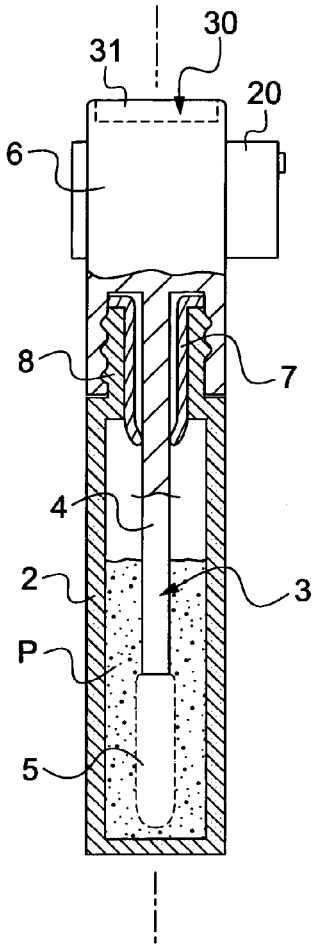
Fig.4
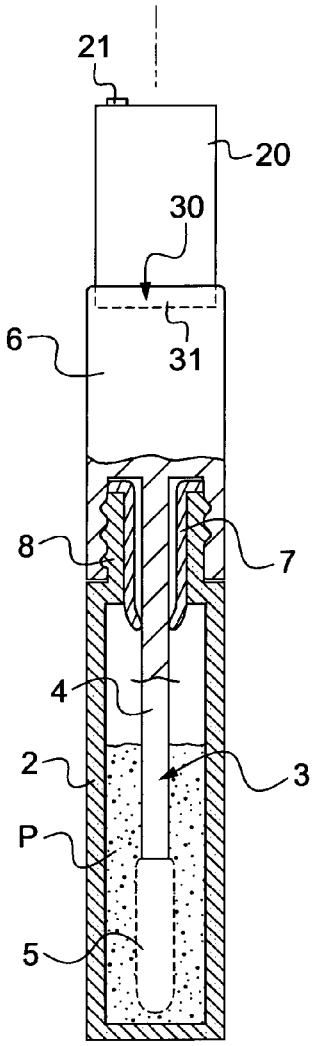
Fig.5
Fig.6
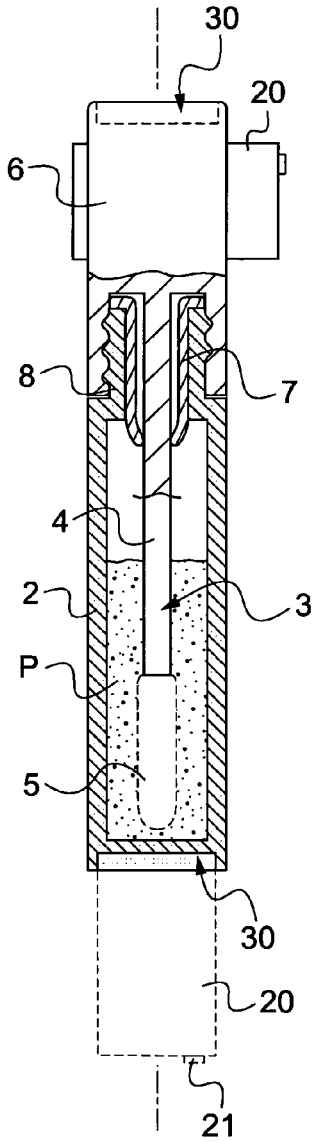

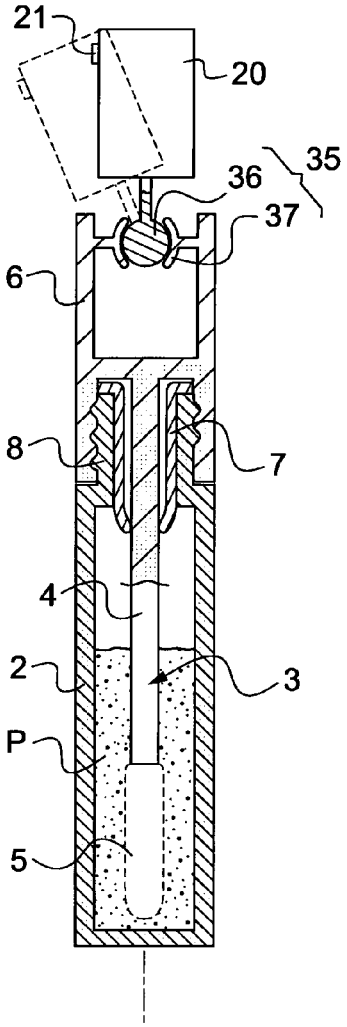
Fig.7
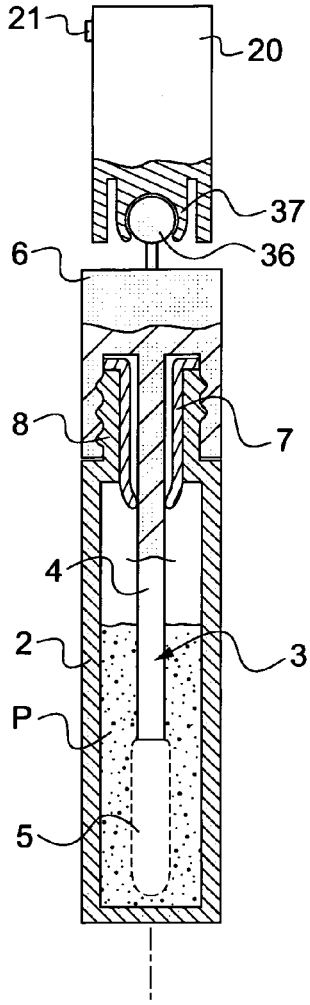
Fig.8
Fig.9
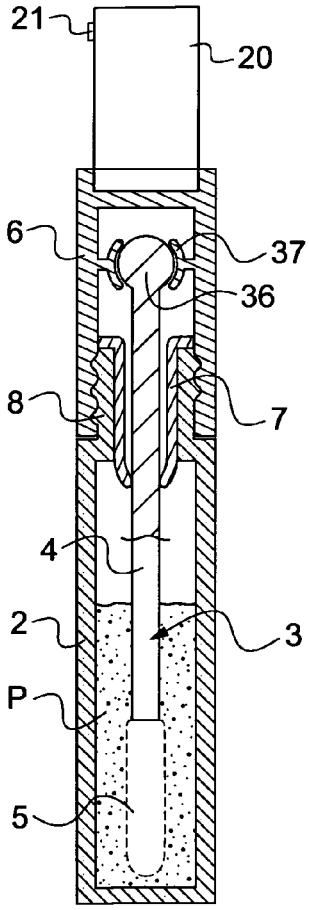

VIBRATOR APPLICATOR HAVING SELECTIVE VIBRATION ORIENTATION

The present invention relates to vibrator applicators and to vibrator packaging and applicator devices for applying a composition, in particular a cosmetic.

French patent FR 2 882 506 and application WO 2006/090343 disclose methods of applying cosmetic treatments by means of vibrator applicators.

US application No. 2004/0185067 relates to an ultrasound generator for use in cleaning the skin and applying makeup.

WO 2006/020577 and WO 2006/130642 disclose mascara vibrator applicators. The kind of vibration produced during application, in particular its amplitude and its frequency, depends only on the vibration source, and in particular on the characteristics of the element at the origin of the vibration, e.g. the speed of rotation of a motor. However, it may turn out to be desirable to exert control over the vibration from a single vibration source, e.g. its direction.

Application FR 2 904 923 relates to a device that assists in applying a composition, the device being suitable for fastening to a finger and serving to produce vibration.

There exists a need to improve still further applicators and packaging and applicator devices that include vibration sources, so as to improve the quality of a makeup effect or of a care treatment and/or to improve the performance of compositions.

More generally, there exists a need to be able to act on the vibration applied to the applicator member in order to match it better to the makeup or to the treatment being performed.

A need also exists to propose novel cosmetic treatment methods to consumers.

The invention seeks to satisfy at least one of those needs.

In exemplary embodiments, the invention thus provides an applicator for applying a cosmetic composition, the applicator comprising:

an applicator member;

a vibration source; and means enabling the user to orient the vibration of the vibration source relative to the applicator member selectively in at least two different orientations, at one or more predefined locations on the applicator.

The invention offers novel possibilities for applying makeup or a care product.

The invention makes it possible, during application or between two applications, to modify the orientation of the vibration produced. For example, the modification may take place while not in use, while not applying composition and/or while not generating vibration. The modification may also take place while the applicator is being removed from the container.

The device according to exemplary embodiments of the invention thus makes it possible to obtain different makeup effects as a function of the orientation of the vibration.

In addition, in the invention, the vibration source is situated at a predefined location on the applicator. Reproducible characteristics may easily be obtained from one use to another, and that would not be possible with a vibration source that could be fitted on the applicator in any position.

The applicator may comprise a closure cap for closing a container containing the composition for application. In particular, the applicator may be separate from the container during application.

The closure cap may comprise means enabling it to be fastened on the container, e.g. a mounting skirt that is threaded or arranged so as to snap-fasten on the container. In particular, the container may be closed in leaktight manner.

The applicator may comprise a joint making it possible to vary the angle of the vibration of the vibration source relative to the applicator member. The joint may enable pivoting along one or at least two axes, for example. The orientation of the vibration of the vibration source relative to the longitudinal axis of the applicator may be modified through at least 90°.

The applicator member may be connected via a stem to the closure cap, and the joint may be at a distance from the stem. In this event, the orientation of the stem relative to the closure cap may be fixed.

In a variant, the joint may be adjacent to the proximal end of a stem carrying the applicator member. In this event, the orientation of the vibration relative to the applicator member may be varied by varying the inclination of the stem relative to the closure cap.

The applicator may define a location, e.g. a housing, making it possible, on its own, or with the help of a second location, e.g. also a housing, to position the vibration source on the closure cap in at least two configurations in which the vibration has different orientations relative to the applicator member. The first location may be a housing that opens out laterally relative to the longitudinal axis of the device. Such a housing may be situated in the closure cap beyond a portion of the cap that closes the container in leaktight manner. The first location may also be defined by a form other than a housing, e.g. a projecting portion in relief such as a pin on which the vibration source is engaged.

By way of example, passing from one configuration to the other may be performed by separating the vibration source from the closure cap so as to position it differently at said location, or to position it at another location on the closure cap.

By way of example, the other location may be situated at an axial end of the closure cap, e.g. being formed by a housing that opens out axially, for example.

Passing from one configuration to the other may also be performed by turning the vibration source at said location, e.g. turning it in the housing.

By way of example, the vibration source may be moved without changing place. The term "moved without changing place" should be understood to mean that the vibration source is movable about a longitudinal axis that may be its axis of symmetry. The vibration source may be circularly symmetrical so as to facilitate such turning.

The vibration source may be turned about its longitudinal axis through an angle of about 90° for example, so as to modify the orientation of the vibration relative to a longitudinal axis of the applicator and/or a longitudinal axis of the applicator member.

In at least one orientation of the vibration source, the vibration may be transverse to the longitudinal axis of the vibration source.

When the applicator comprises a housing receiving the vibration source, the housing may be a blind housing or a through housing. By way of example, the housing may be axially symmetrical, e.g. circularly symmetrical, in such a manner as to enable the vibration source to be moved in the housing without changing place. By way of example, the housing is formed in the closure cap.

In order to modify the orientation of the vibration source, the user may remove the vibration source from the housing and put it back into the same housing with the desired orientation, for example.

In a variant, the user may turn the vibration source without it leaving the housing. By way of example, the housing may hold the vibration source by friction, so that said vibration source remains in the orientation in which it is left by the user.

The vibration source may also change place on the applicator, e.g. change housing, in order to modify its orientation.

The vibration source may be held on the applicator, e.g. within the housing, by friction, by snap-fastening, by screw-fastening, by locking using an auxiliary part, magnetically, by mechanical catching of the "Velcro" type using hooks and loops, or by adhesive, e.g. by means of repositionable adhesive.

The vibration source may be masked in part, or almost entirely, in the housing that receives it, e.g. being covered over a major fraction of its length by the applicator, when it is disposed in the housing.

The joint may enable pivoting about one or at least two axes, for example.

The joint may comprise a head formed on one of the stem, the closure cap, and the vibration source, the head being engaged in a seat of complementary shape formed on another one of the stem, the closure cap, and the vibration source. The head may be of shape that is generally spherical in order to form a ball joint.

The applicator may comprise a system for rotating the applicator member.

The vibration source may be disposed in the extension of the closure cap, in particular in the presence of a joint making it possible to vary the orientation of the vibration relative to the applicator member.

The term "joint" should be understood to mean a connection between at least two distinct parts, one being movable relative to the other about at least one axis of rotation, or about at least two axes. The two jointed parts may also be connected together via a flexible portion that acts as a joint, e.g. a film hinge.

The device may comprise a single joint connecting the applicator member and the vibration source. The joint makes it possible to adjust the inclination of the vibration relative to the applicator member, the adjustment possibly being continuous, by increments, or between extreme positions. By way of example, the adjustment amplitude may reach or exceed 90° about an axis that is perpendicular to the longitudinal axis of the device.

The desired orientation may be held by means of sufficient friction between the joint parts, or by orientation-holding means, e.g. by means of a clamping screw or by means of notches.

By way of example, the joint may be in the form of a ball joint comprising a head that is generally spherical engaged in a seat of complementary shape. By way of example, the joint may also comprise a hinge or a universal joint as mentioned above.

The joint makes it possible to select a plurality of stable orientations of the applicator member relative to the vibration, the orientation being selected by the user, e.g. while not applying composition or while removing the applicator from the container. While the orientation of the vibration is being set, the vibration source may optionally be in operation.

The joint may optionally be made to enable the parts it joins together to be separated. The possibility of separation may be useful, e.g. for enabling the vibration source to be used on another applicator.

As mentioned above, the applicator may comprise a stem, at a first end of which the applicator member is fastened in optionally-separable manner. The stem may comprise a second end that is fastened to the closure cap of the container containing the composition, or in variants to any other handle member.

The joint may connect the stem and the closure cap. For example, the head of the above-mentioned ball joint may be formed at one end of the stem, with the seat of complementary shape being formed on the closure cap.

In a variant, the joint may connect the closure cap and the vibration source. For example, the head of the ball joint may be formed on the closure cap and the seat of complementary shape may be formed on the vibration source. Still in a variant, the head may be formed on the vibration source and the seat of complementary shape may be formed on the closure cap. More generally, the head of the joint may be formed on one of the stem, the closure cap, and the vibration source, the seat of complementary shape being formed on another one of the stem, the closure cap, and the vibration source.

The seat may be made of a flexible material making it possible to snap-fasten the head of the joint in the seat, e.g. between the extensible tabs of the seat. Such a joint makes it possible to pivot the vibration source relative to the applicator member, and to prevent perceptible axial and/or lateral movement of the vibration source at the joint relative to the applicator member.

In an embodiment, the orientation of the vibration source relative to the closure cap may be fixed, and the orientation of the closure cap relative to the applicator member may be adjustable.

In another embodiment, the orientation of the vibration source relative to the closure cap may be adjustable, and the orientation of the closure cap relative to the applicator member may be fixed.

The device may also be configured to enable the vibration source to be fastened selectively at least a first position disposed in the extension of the closure cap of the container, and at a second position on one of the applicator and the container. The vibration source may be moved by detaching it from the device and by fastening it at the new location. The term "in the extension of the closure cap" should be understood to mean that the closure cap is situated between the location where vibration is generated and the applicator member, on the longitudinal axis of the device.

A longitudinal axis of the vibration source and a longitudinal axis of the closure cap of the container may be parallel when the vibration source is placed in the first position, the axes being spaced apart from each other by a distance that is less than half the size of the closure cap measured perpendicularly to the longitudinal axis, for example. The axes may also coincide.

By way of example, the first position may be defined by a housing of the applicator, situated at one end of said applicator, for example, and opening out in a direction opposite to the applicator member, for example.

The container may define a fastener position for fastening the vibration source on the container, e.g. in the bottom of the container, e.g. by means of a housing situated in the end of the container remote from a dispenser opening, and where appropriate remote from a neck provided with said opening.

In a variant or in addition, the applicator may define at least two different fastener positions for fastening the vibration source. By way of example, the second position may be defined by a blind or through housing of the applicator. The housing may be axially or cylindrically symmetrical, in such a manner as to enable the vibration source to move in the housing without changing place. The housing may be formed through a surface that serves as the grip surface of the applicator.

The vibration source may comprise first fastener means that are arranged to co-operate with second fastener means of the container or of the applicator.

The vibration source may be configured to cause the applicator member and/or the applicator and/or the container and/or a wiper member of the device to vibrate.

The vibration source need not have removable fastener means for fastening to at least one finger.

The device may comprise visual indicator means for visibly indicating the orientation of the vibration source relative to the remainder of the device. The visual indicator means may comprise a positioning indicator on the vibration source and one or more graduations on the remainder of the device.

The device may comprise a wiper member for wiping the applicator member. The wiper member may be held on the container containing the composition, and may wipe the applicator member while said applicator member is being removed from the container.

Depending on whether or not the vibration source is operating and/or depending on its location, different wiping effects, and therefore different application effects, may thus be obtained.

The vibration source may be configured to cause the wiper member to vibrate via the container when the vibration source is fastened to the container, or via the applicator member when the vibration source is fastened to the applicator.

The applicator may be separated from the container for application purposes, and the applicator member may pass through the wiper member. Vibration may be transmitted to the applicator member and to the wiper member while the applicator member is being removed from the container.

The wiper member may comprise a wiper lip made of elastomer. In a variant, the wiper member may comprise a block of foam that is slotted, enabling the applicator member to pass therethrough. The wiper member may be made out of one or more plastics materials. The wiper member may define a wiper orifice of diameter that is less than, equal to, or greater than the diameter of the stem, at the portion of said stem facing the wiper orifice when the applicator is in place on the container.

Other exemplary embodiments of the invention also provide a packaging and applicator device for applying a cosmetic composition, the device comprising:

a receptacle containing the composition;

an applicator comprising an applicator member; and a vibration source;

the device being configured to enable the vibration source to be fastened selectively at least a first position disposed in the extension of the closure cap of the container, and at a second position on one of the applicator and the container.

Vibration Source

The vibration source may be configured to generate vibration, e.g. sinusoidal vibration, of frequency lying in the range 0.5 hertz (Hz) to 1000 Hz, for example, or in the range 1 Hz to 500 Hz, better in the range 10 Hz to 300 Hz, e.g. in the range 50 Hz to 200 Hz. The frequency may vary as a function of the location or of the pressure with which vibration is transmitted. Vibration may be produced in intermittent or continuous manner.

In particular for such frequency ranges, the vibration produced is not ultrasound.

The vibration source may comprise a vibration generator comprising a motor, e.g. a disk-shaped motor that rotates a fly-weight, in particular an off-center fly-weight.

The vibration generator may be different, e.g. piezoelectric, electromechanical, or eccentric. The vibration generator may also comprise a motor that rotates a toothed wheel in contact with a rattle comprising an elastically-deformable blade.

The speed of rotation of the motor may lie in the range 50 revolutions per minute (rpm) to 20,000 rpm. The speed of rotation of the motor may lie in the range 4500 rpm to 10,000 rpm, for example.

The voltage used may be 1.5 volts (V) to 3 V, for example. The vibration source may comprise an electricity source, e.g. a 1.5 V battery.

By way of example, the motor may be arranged in such a manner that when it is connected to a 1.5 V battery, it rotates at a speed lying in the range 50 rpm to 20,000 rpm.

The use of a button battery may be advantageous in making the device more compact. When using a button battery and a disk-shaped motor, the battery and the motor may be face to face, side by side, or the face of one may face the edge of the other.

The vibration source may comprise a control member for controlling its operation. The control member may respond to being pressed. The control member may be disposed in such a manner that it is pressed when the user takes hold of the device, the container, or the applicator. The control member may be a control member having momentary contact, the operation of the vibration source ceasing when the control member is released.

The device may be configured so as to enable the vibration source to be actuated automatically when said vibration source is put into place on the remainder of the device. In a variant, actuation of the vibration source may be initiated by the user acting on a contactor while said source is in place.

Moving the vibration source in its housing need not interrupt its operation.

The device may also define a storage position for the vibration source, in which the vibration source is not actuated when it is placed therein.

The vibration source may comprise a casing housing the electric motor, an electric contactor for switching on the motor, and at least one optionally-rechargeable battery. The motor may be contained in a metal case with the off-center fly-weight, the case being disk-shaped, for example. Where appropriate, the case may be used to supply electricity to the motor. The motor or the above-mentioned case may be mounted on a damper made of elastomer that makes it possible to transmit vibration at the fundamental frequency and to filter out vibration at harmonic frequencies, for example.

The vibration produced may be oriented substantially parallel to the longitudinal axis of the device and/or substantially parallel to the longitudinal axis of the applicator and/or substantially parallel to the longitudinal axis of the applicator member.

In a variant, the vibration may be oriented substantially perpendicularly to the longitudinal axis of the device and/or substantially perpendicularly to the longitudinal axis of the applicator and/or substantially perpendicularly to the longitudinal axis of the applicator member.

The orientation of the vibration may be modified by modifying the position of the vibration source, in accordance with the invention. The orientation of the motor relative to the applicator member may be modified when the vibration source is moved.

Advantages provided by the invention when the vibration source controls a disk-shaped motor are described below. The disk-shaped motor of the vibration source has an axis of rotation.

When fastened on the device in a first fastening position, the vibration source may be oriented in such a manner that the axis of rotation of the motor is parallel to the longitudinal axis of the device and/or of the applicator and/or of the applicator member.

In a second position of the vibration source relative to the device, the axis of rotation of the motor may form an angle, e.g. of 90°, with the longitudinal axis of the device and/or of the applicator and/or of the applicator member. The device may be configured so that the angle may be set by the user at any desired value, e.g. lying in the range 0 to 180°, in continuous manner or at predefined values imposed by adjustment notches, for example.

The vibration source may comprise an adjustment member that enables the user to adjust the frequency and/or the amplitude of the vibration produced. During application, the vibration amplitude of the applicator member may be less than or equal to 5 millimeters (mm), for example, and better less than or equal to 3 mm, with microvibration of the applicator being preferable to vibration of greater amplitude. The amplitude of the vibration may possibly be greater while the composition is being taken from the container or while the applicator member is passing through the wiper member.

The vibration source may be fastened to the applicator, being held on the applicator during application of the composition.

The shape of the handle may be adapted to the shape of the vibration source so as to improve the direct transmission of vibration between the vibration source and the applicator.

Applicator Member

The device according to exemplary embodiments of the invention may comprise an applicator member of any type. The vibration produced may depend on the applicator member.

The device may have only a single applicator member, e.g. not having a second applicator member or a finishing, preparation, or massage member.

The applicator member may be configured to make it possible to apply a composition to a region being made up or being treated. It may be used for taking composition, for applying composition, or after composition has been applied.

The applicator member may be arranged to apply a composition to the eyelashes or the hair, and it may comprise a brush or a comb, for example, that may be flocked, for example. The brush may comprise a twisted core and bristles between the turns of the core, or it may be made in some other way. The core may have a righthand twist or a lefthand twist, or it may have two cores that are twisted together. By way of example, the comb may be made as a single part by molding a rigid or flexible plastics material, by injection molding or over-molding. The applicator member may be off-center. It may have a cross-section of shape that is optionally circular.

The applicator member may also comprise a paint brush for application to the nails, the lips, or the skin. The applicator member may comprise bristles that are held by adhesive or by staples, twisted bristles, a non-woven fabric, a felt, flocking, or foam.

The applicator member may also comprise a capillary applicator element that is configured to retain the composition by capillarity, and that comprises, for example, a tubular wall, and an internal element that cooperates with the tubular wall to define a space for retaining the composition by capillarity. Such an applicator member may be useful for applying a composition to the nails, for example.

In a variant, the applicator member may comprise threads or a succession of annular stripes, the applicator member being formed by a stack of disks, for example. Such an applicator member may be used for applying composition to keratinous fibers.

In a variant embodiment, the applicator member may comprise an endpiece, in particular a flocked endpiece, that is possibly elastically deformable. Such an applicator member may be used for applying composition to the skin, the lips, or the eyelashes, for example.

In a variant embodiment, the applicator member may comprise a member that is elastically compressible and/or porous, e.g. a porous foam or elastomer that is optionally flocked.

In a variant embodiment, the applicator member may comprise a felt.

The applicator member may be magnetic.

Stem

In a variant embodiment, the stem of the applicator may be flexible, thereby contributing to increasing the amplitude of the vibration of the applicator and/or to improving comfort in application.

The stem may comprise a flexible portion made of a material that is softer than a material used to make the remainder of the stem. The flexible portion makes it possible to transmit vibration as far as the applicator member, e.g. while damping it or, on the contrary, while amplifying it depending on the shape of the portion, and on the direction and the frequency of the vibration.

The flexible portion may be made of an elastically-deformable material, e.g. made of elastomer.

The joint making it possible to modify the orientation of vibration relative to the applicator member may be at a proximal end of the stem.

Composition

The composition may be a cosmetic, makeup, or a care product.

By way of example, the composition may be deposited on: keratinous fibers, in particular the eyelashes, the eyebrows, or the hair; mucous membranes; the lips; fingernails and/or toenails; the eyelids; eye contours; the face; and/or the body.

By way of example, the composition is a composition for applying to: the nails; the skin; keratinous fibers, in particular the eyelashes, the eyebrows, or the hair; the lips; e.g. a mascara, an eyeliner, a nail varnish, a lipstick, a lipgloss, a foundation, a blusher, an eyeshadow, an eye-contour concealer, an under-eye dark-circle concealer, a self-tanning agent, or even a care product for the eyelashes, the eyebrows, the lips, the skin of the face, the skin of the cheeks, the fingernails and/or the toenails, this list not being limiting.

In particular, the composition may be different from a toothpaste and from a body-scrub, and in particular it may contain pigments, in particular inedible pigments. The composition may contain fibers, glitter, or other macroscopic elements. The composition may present magnetic properties, where appropriate.

The composition may also be a care product, in particular a blemish concealer, an anti-wrinkle cream, an under-eye puffiness concealer, a body lotion, or a root treatment, in particular for encouraging the growth of hair. The composition may also be a massage composition for the face or the body.

Method

Independently or in combination with the above, the invention also provides a cosmetic treatment comprising the following steps:

- applying composition by means of an applicator as defined above;
- modifying the position of the vibration source; and
- applying composition once again and/or combing and/or finishing and/or massaging by means of the applicator.

The invention may be better understood on reading the following detailed description of non-limiting embodiments thereof, and on examining the accompanying drawings, in which:

FIGS. 4 and 5 are elevation views, partially in longitudinal section, showing a variant embodiment of the invention;

FIGS. 6 to 9 are elevation views, partially in longitudinal section, showing variant embodiments of the invention;

Figure 1:
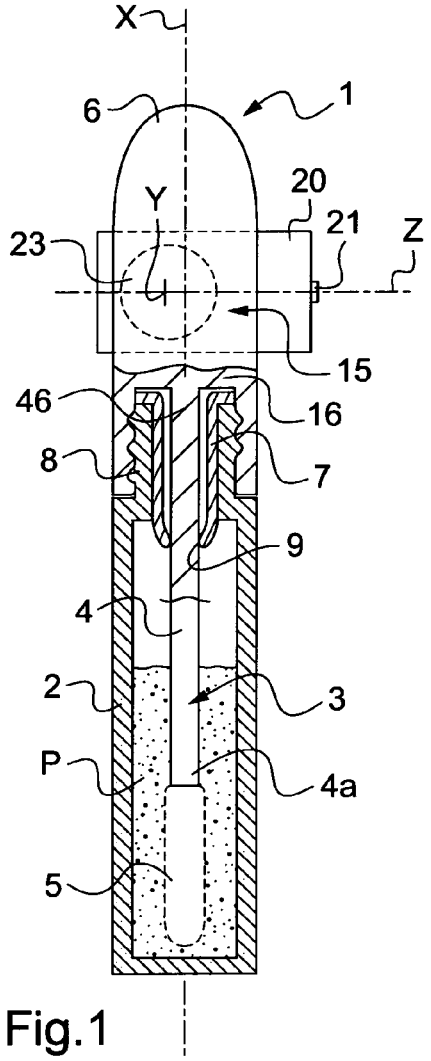
FIG. 1 is an elevation view, partially in longitudinal section, showing a packaging and applicator device made in accordance with the invention.
Figure 2:
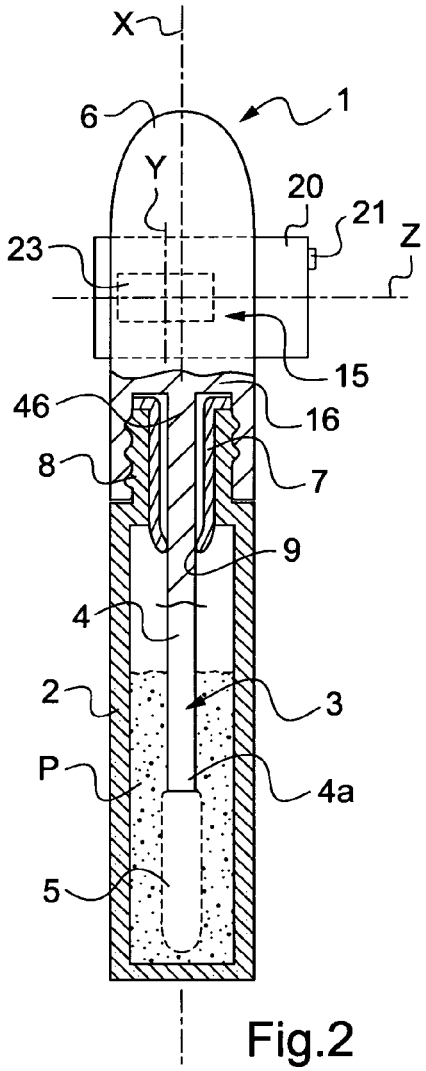
FIG. 2 is an elevation view, partially in longitudinal section, showing the FIG. 1.

FIGS. 1 and 2 show a packaging and applicator device 1 comprising: a container 2 containing a composition P for application; and an applicator 3 comprising a stem 4 that is provided at its distal end 4*a* with an applicator member 5, and that is connected at its proximal end 4*b* to a handle 6 that also constitutes a closure cap for closing the container 2. The closure cap may be configured to cover a dispenser opening, and, where appropriate, to close the container in leaktight manner.

The container 2 is fitted with a wiper member 7, e.g. constituted by a part made of elastomer, that is inserted into the neck 8 of the container 2. The wiper member 7 may optionally be conventional, indeed it may be adjustable.

The handle 6 is arranged to close the container 2 in leaktight manner when it is closed fully on the neck 8, in manner known per se.

In the embodiment shown, the wiper member 7 defines a wiper orifice 9 of circular section having a diameter that corresponds substantially to the diameter of the stem 4, and, in the embodiment shown, said stem being of circular cross-section, at least over its portion engaged in the container.

In the embodiment under consideration, the stem 4 presents a longitudinal axis X that is rectilinear, and that coincides substantially with the axis of the neck 8 of the container 2 when the applicator 3 is in place on said container.

In an embodiment, the applicator member 5 may be a brush including a core that is formed by two twisted metal strands, the core having a proximal portion that is fastened in a housing of the stem, e.g. being force fitted in the housing. The core may carry bristles that are held by clamping between the turns of the core, and that extend substantially radially from the core. In a variant embodiment, the applicator member may be different, e.g. it may comprise a comb, an injection-molded brush, a molded and/or flocked endpiece, or a paint brush, amongst others, as described below.

The handle 6 may define a through housing 15, open on either side of the longitudinal axis X, and having axial or circular symmetry, for example. By way of example, the housing is of axis Z that is perpendicular to the axis X, and the axis Z may intersect the axis X. The housing 15 is configured to receive a vibration source 20.

As shown, the housing 15 may be defined by a tubular wall of the closure cap that defines a grip surface provided with two openings via which the housing 15 opens to the outside. The vibration source may optionally come into contact with a transverse wall 16 to which the stem 4 is connected.

The housing 15 may also be defined by an insert fastened in an opening of the cap.

Vibration may be transmitted to the applicator member 5 directly or via any element interposed in the vibration transmission chain between the vibration source 20 and the applicator member 5.

It is not beyond the ambit of the present invention for the stem 4 to be fitted to the handle 6, or for said handle to be made by assembling together at least two parts, one of which carries the stem 4.

The vibration source 20 includes one or more components that generate vibration when electrically powered, and enables said vibration to be transmitted to the applicator, to the applicator member, to the container, or even to the wiper member.

Figure 3:
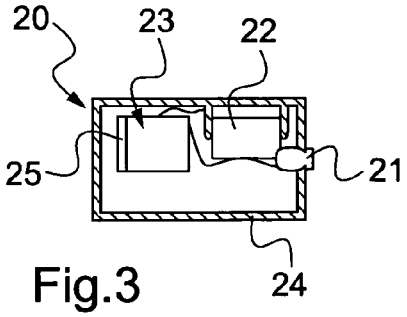
FIG. 3 is a fragmentary and diagrammatic longitudinal section of a detail of the vibration source of FIG. 1.

In the embodiment under consideration, the vibration source 20 includes a casing 24 that houses an electricity source 22 that makes it possible to power a motor 23 electrically, e.g. one or more optionally-rechargeable batteries, as shown in FIG. 3. In the embodiment described, the casing 24 is cylindrically symmetrical so as to be able to turn about its own axis in the housing 15.

Figure 12:
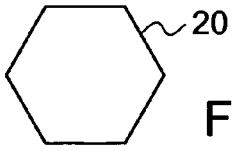
FIG. 12 shows a variant embodiment of a vibration source.

In a variant, the casing may be of cross-section that is not circular, e.g. polygonal, square, or hexagonal, as shown in FIG. 12. In this event, it is necessary to remove the vibration source from its housing 15 in order to turn it and to replace it on the applicator to produce vibration with a different orientation.

By way of example, the casing 24 may be made with at least two portions that are assembled together after the motor 23, the electricity source 22, and various electrical-connection and operation-control means have been put into place.

The portions of the casing 24 may be optionally selected to be separable if it is desired to be able to replace the electricity source once it is spent. The vibration source 20 may possibly be made with a flap making it possible to replace the electricity source without having to dismantle the casing 24.

The vibration source may be switched on by means of a control member 21, e.g. a contactor that is operated by being pressed. The control member 21 may be made in various ways, and may comprise a flexible metal blade that closes an electrical circuit when deformed by the user. The control member 21 is advantageously a control member presenting momentary contact, i.e. it changes state when the user actuates it, and returns to its initial state when the user releases it. The control member could also be a control member presenting permanent contact.

In a variant, the control member 21 may include a timer that ensures it operates for a predetermined duration, after brief actuation.

Still in a variant, operation may be started by a press on the control member 21, then stopped by another press.

The control member 21 may be actuated by the user, while the vibration source 20 is in place in the handle 6.

The motor 23 may drive an off-center fly-weight, the motor preferably being a disk-shaped motor. By way of example, the vibration source 20 comprises a 1.5 V battery. By way of example, the motor is arranged to rotate at a speed of rotation lying in the range 5000 rpm to 12,000 rpm, when powered by the 1.5 V battery. The motor may be contained with the off-center fly-weight in a disk-shaped casing 25.

Depending on the orientation of the vibration source relative to the device, and in particular depending on the orientation of the axis of rotation of the motor 23, vibration may be generated either substantially transversally to the longitudinal axis X of the device 1, as shown in FIG. 2, or substantially parallel to the longitudinal axis, as shown in FIG. 1, or even in some other way.

The orientation of the transmitted vibration may be selected by selecting the orientation of the vibration source 20 relative to the longitudinal axis X. By way of example, FIGS. 1 and 2 show two examples of relative positions for the vibration source.

In the example in FIG. 1, the axis of rotation Y of the motor 23 is oriented perpendicularly to the longitudinal axis X, and in FIG. 2, the axis of rotation Y of the motor 23 is oriented parallel to the longitudinal axis X. The orientation of the transmitted vibration is thus offset by 90° between the configurations in FIGS. 1 and 2.

By way of example, the fundamental frequency of the vibration generated by the motor lies in the range 0.5 Hz to 1000 Hz, e.g. lies in the range 10 Hz to 300 Hz, or even in the range 50 Hz to 200 Hz.

FIGS. 4 and 5 show an embodiment in which the handle 6 of the applicator 3 includes a housing 31 formed at its end that defines a first fastening position for fastening the vibration source. The vibration source 20 may also be moved between the first fastening position, situated in the extension of the closure cap of the container, and a second fastening position situated on one of the applicator and the container. The housing 15 shown in FIGS. 1 and 2 may define such a second fastening position for fastening the vibration source 20 on the applicator 3.

By way of example, the housing 31 is cylindrically symmetrical, being configured in such a manner as to receive an end portion of the vibration source 20 that is remote from the control member 21, as shown in FIG. 5.

In another variant, the container may define the second fastening position 30 for fastening the vibration source, as shown by dashed lines in FIG. 6.

The device may define only two different fastening positions, or more than two fastening positions.

In other variant embodiments, the device may include adjustment means for adjusting the orientation of the vibration source relative to the applicator member, the vibration source being connected to the applicator member via a joint.

The joint may be disposed outside the zone that is exposed to the vapors from the solvent(s) contained in the composition.

FIGS. 7 to 9 show devices according to exemplary embodiments of the invention, including a joint such as a ball joint for example, on the vibration path between the vibration source 20 and the applicator member 5.

By way of example, the joint 35 comprises a head 36 that is generally spherical, and a seat 37 of complementary shape.

In the embodiment shown in FIG. 7, the head 36 is formed on the vibration source 20, e.g. being molded integrally with the casing of the vibration source. The seat of complementary shape is situated on the handle 6 of the device, e.g. being molded integrally with a skirt of the closure cap, that defines the grip surface of the applicator.

In the embodiment shown in FIG. 8, the head 36 is formed on the handle 6, the vibration source 20 including the seat 37 of complementary shape, said seat being made with resilient tabs that are made out of a flexible material, making it possible to snap-fasten onto the head 36. FIG. 9 shows a variant embodiment in which the head 36 is formed at the end of the stem 4, while the seat 37 is formed on the handle 6.

As described above, the handle 6 may define at least one fastening position for fastening the vibration source 20, so as to secure it to the handle 6.

Figure 10:
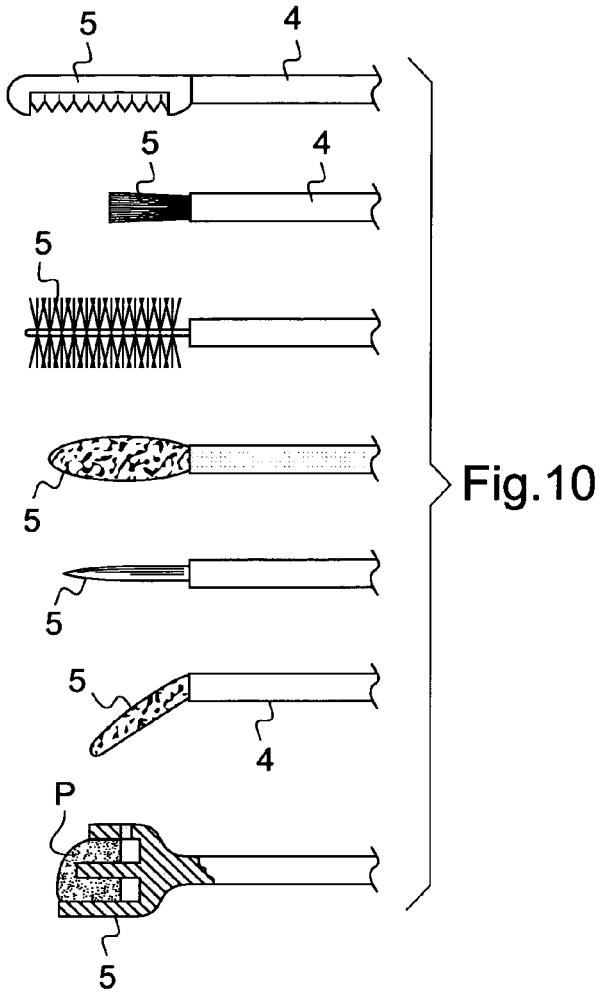
FIG. 10 shows variant embodiments of applicator members.

FIG. 10 shows different examples of applicator members 5 that may be present in the device according to exemplary embodiments of the invention, in particular a comb for the eyelashes or the eyebrows, a paint brush, a mascara brush, a foam endpiece, a felt tip, a flocked endpiece, and a capillary applicator that is capable of holding the composition by capillarity.

Where appropriate, the applicator member may also include a sheath that may surround the applicator element and/or the stem at least in part, so as to constitute a supply of composition.

Figure 14:
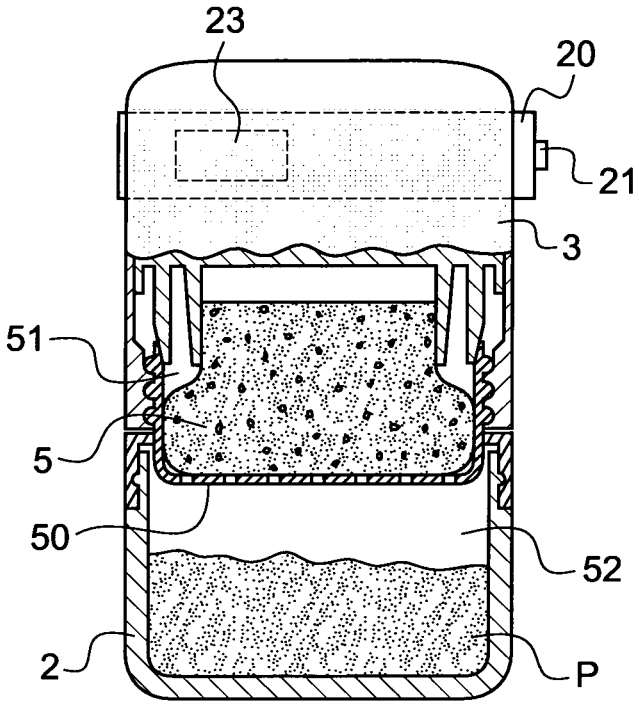
FIG. 14 is a fragmentary and diagrammatic longitudinal section of a variant embodiment of the invention.

In the embodiment in FIG. 14, the applicator member 5 is loaded with composition P via a perforated wall 50 that separates a housing 51 receiving the applicator member 5 when the container 2 is closed by the applicator 3, and a space 52 containing the composition P. The applicator 3 is fastened to the container 2 by screw-fastening, for example.

Figure 11:
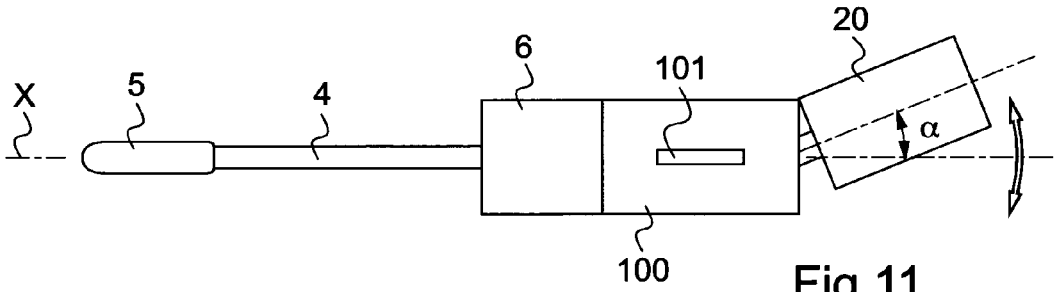
FIG. 11 shows a variant embodiment of the device.

The applicator member may be rotated by a motorized drive system 100, as shown in FIG. 11, relative to the grip surface.

By way of example, the drive system 100 comprises an electric motor or one or more batteries.

A contactor 101 enables the user to start operation of the motor.

By way of example, the drive system 100 may rotate the stem about its axis by rotating the closure cap 6.

By way of example, the vibration source 20 is fastened in jointed manner to the drive system 100, e.g. so as to pivot about an axis that is perpendicular to the axis X, making it possible to adjust the angle of inclination $\alpha$, or it is fastened more freely by means of a ball joint.

The vibration source 20 may be fastened in optionally-removable manner on the drive system 100.

Figure 13:
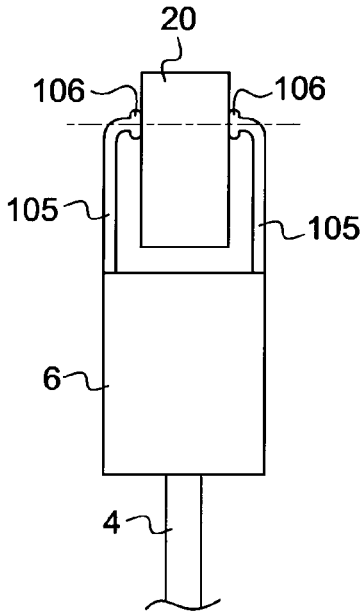
FIG. 13 is a fragmentary and diagrammatic elevation view of a variant embodiment.

The vibration source may be mounted on the closure cap in such a manner as to pivot through 360°, e.g. about an axis of rotation that is perpendicular to the longitudinal axis of the applicator. In an embodiment, as shown in FIG. 13, the vibration source is mounted between two arms 105 that define a joint. By way of example, each of the arms 105 presents an angled end 106 that is engaged on a portion in relief, of complementary shape, of the vibration source 20. In the embodiment in FIG. 13, the vibration source may be oriented with its longitudinal axis coinciding with the longitudinal axis of the applicator, and it may also take up any orientation about the axis of its joint to the closure cap. The vibration source may be fastened in removable manner on the closure cap by means of the elasticity of the arm 105.

The invention is not limited to the embodiments shown.

The characteristics of the various embodiments shown and described may be combined together within variants that are not shown.

For example, the applicator members shown may be replaced by others. The housings receiving the vibration source may be replaced by projections making it possible to fasten the vibration source at predefined locations.

The vibration source may be proposed to the user pre-assembled on the container or on the applicator within a package that is a case, a bag, a blister pack, or a box, for example. In a variant, the vibration source may be in the non-assembled state with the applicator or the container within the package. The vibration source may be proposed with at least two different containers or two different applicator members within a single package.

The expression "comprising a" should be understood as being synonymous with "comprising at least one" unless specified to the contrary.

The invention claimed is:

1. An applicator for applying a cosmetic composition, the applicator comprising:

an applicator member;

a vibration source;

means enabling the user to orient the vibration of the vibration source relative to the applicator member selectively in at least two different orientations, at one or more predefined locations; and a closure cap for closing a container, said means defining a location making it possible, on its own, or with the help of a second location, to position the vibration source on the closure cap in at least two configurations in which the vibration has different orientations relative to the applicator member, passing from one configuration to the other being performed by separating the vibration source from the closure cap so as to position it differently at said location, or to position it at the second location on the closure cap.

2. An applicator according to claim 1, said means comprising a joint making it possible to vary the angle of the vibration of the vibration source relative to the applicator member.

3. An applicator according to claim 2, the applicator member being connected via a stem to the closure cap for closing the container, and the joint being at a distance from the stem.

4. An applicator according to claim 2, the joint being adjacent to the proximal end of a stem carrying the applicator member.

5. An applicator according to claim 2, in which the joint enables pivoting along at least two axes.

6. An applicator according to claim 5, in which the joint comprises a head formed on one of a stem, the closure cap, and the vibration source, the head being engaged in a seat of complementary shape formed on another one of the stem, the closure cap, and the vibration source.

7. An applicator according to claim 1, passing from one configuration to the other being performed by turning the vibration source at said location.

8. An applicator according to claim 1, wherein the orientation of the vibration of the vibration source relative to a longitudinal axis of the applicator may be modified through at least 90°.

9. An applicator according to claim 1, comprising a system for rotating the applicator member.

10. An applicator according to claim 1, the vibration source being disposed in an extension of the closure cap.

11. An applicator for applying a cosmetic composition, the applicator comprising:

an applicator member;

a vibration source;

means enabling the user to orient the vibration of the vibration source relative to the applicator member selectively in at least two different orientations, at one or more predefined locations; and a closure cap for closing a container, said means defining a location making it possible, on its own, or with the help of a second location, to position the vibration source on the closure cap in at least two configurations in which the vibration has different orientations relative to the applicator member, in which said location is defined by a housing that opens out laterally relative to a longitudinal axis of the applicator.

12. An applicator for applying a cosmetic composition, the applicator comprising:

an applicator member;

a vibration source;

means enabling the user to orient the vibration of the vibration source relative to the applicator member selectively in at least two different orientations, at one or more predefined locations; and a closure cap for closing a container, said means defining a location making it possible, on its own, or with the help of a second location, to position the vibration source on the closure cap in at least two configurations in which the vibration has different orientations relative to the applicator member, the second location being situated at an axial end of the closure cap.

* * * * *